US006631532B2

(12) United States Patent
Seehusen

(10) Patent No.: US 6,631,532 B2
(45) Date of Patent: Oct. 14, 2003

(54) ENGINE BLOCK CYLINDER GROOVE CLEANER

(76) Inventor: Gerald Seehusen, 1037 County Rd. 11, Tracy, MN (US) 56175

( * ) Notice: Subject to any disclaimer, the term of this patent is extended or adjusted under 35 U.S.C. 154(b) by 398 days.

(21) Appl. No.: 09/747,882

(22) Filed: Dec. 26, 2000

(65) Prior Publication Data

US 2002/0078517 A1 Jun. 27, 2002

(51) Int. Cl.[7] ..... F23J 1/04; F23J 1/00; F23J 9/06

(52) U.S. Cl. ..... 15/104.012; 15/104.011; 15/104.05; 15/236.01; 30/103

(58) Field of Search ..... 15/104.011, 104.012, 15/104.02, 104.03, 104.05, 104.09, 104.13, 104.15, 104.16, 236.11; 30/103, 104, 105, 106, 107, 108, 113.1; 83/195, 178

(56) References Cited

U.S. PATENT DOCUMENTS 3,938,218 A * 2/1976 DeAmicis ..... 15/401
3,945,104 A * 3/1976 Brookover, Jr. ..... 29/255
4,414,869 A 11/1983 Augustine
4,466,185 A * 8/1984 Montiero ..... 30/103
4,638,541 A 1/1987 Schindler, Jr.
4,648,447 A * 3/1987 Bishop et al. ..... 166/173
4,798,246 A * 1/1989 Best ..... 166/311
5,222,295 A 6/1993 Dorris, Jr.
5,685,078 A * 11/1997 Obst et al. ..... 30/107

* cited by examiner

*Primary Examiner*—Robert J. Warden, Sr.
*Assistant Examiner*—S Balsis
(74) *Attorney, Agent, or Firm*—Kaardal & Leonard, LLP

(57) ABSTRACT

An engine block cylinder groove cleaner for cleaning the grooves in the cylinder of a diesel engine. The engine block cylinder groove cleaner includes a main housing comprising a lower portion. A plurality of groove cleaning members each being outwardly extendable from the lower portion. The groove cleaning member scrapes out debris from a circumferential groove when the main housing is rotated.

20 Claims, 8 Drawing Sheets

FIG. 6
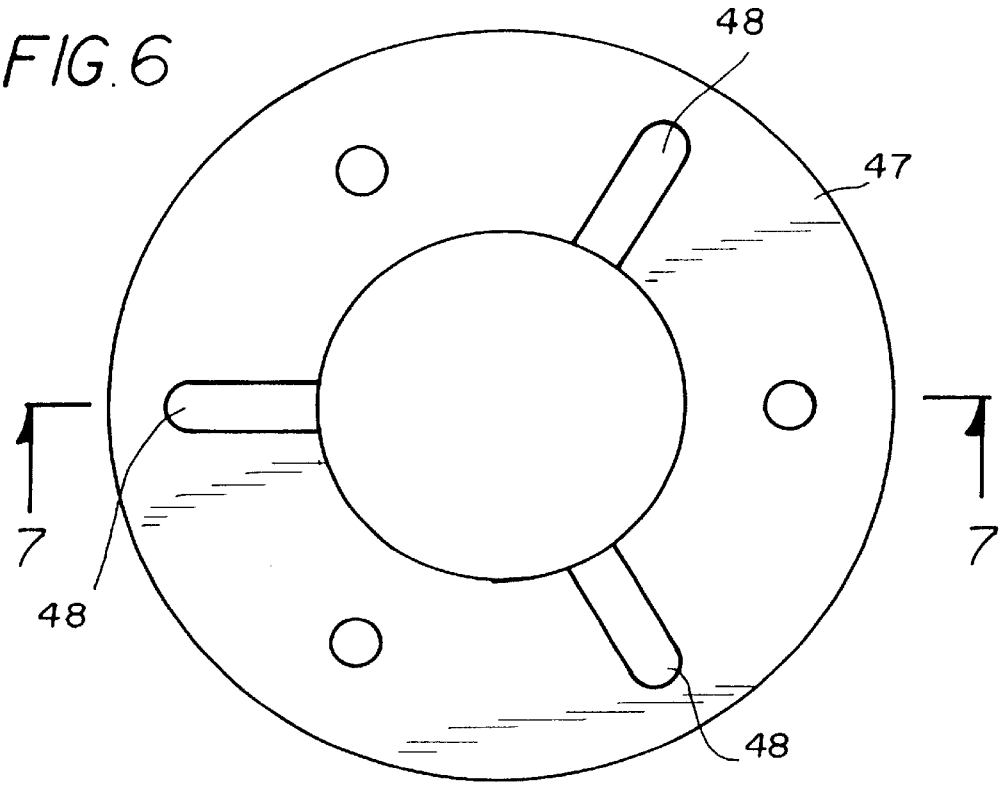
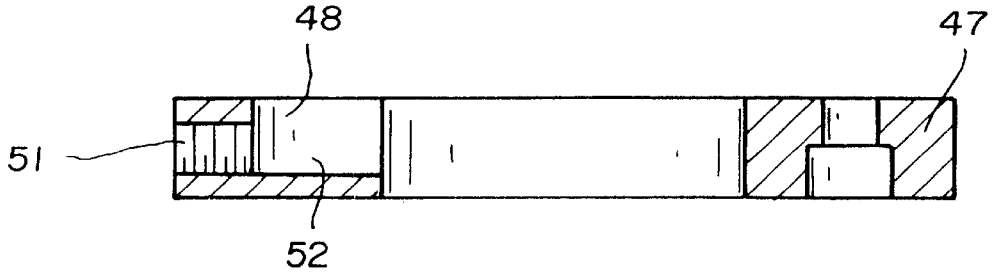
FIG. 7

ENGINE BLOCK CYLINDER GROOVE CLEANER

BACKGROUND OF THE INVENTION

1. Field of the Invention

The present invention relates to extensible cleaning tools and more particularly pertains to a new engine block cylinder groove cleaner for cleaning the grooves in the cylinder of a diesel engine.

2. Description of the Prior Art

The use of extensible cleaning tools is known in the prior art. More specifically, extensible cleaning tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,938,218; 4,414,869; 5,222,295; 4,638,541; and 3,945,104.

While these devices fulfill their respective, particular objectives and requirements, the aforementioned patents do not disclose a new engine block cylinder groove cleaner. The inventive device includes a main housing comprising a lower portion designed for insertion into a cylinder of an engine block. A plurality of groove cleaning members each being outwardly extendable from the lower portion such that a distal portion of each of the groove cleaning members is designed for snug insertion into a circumferential groove extending around the cylinder of the engine block. The groove cleaning member scrapes out debris from the circumferential groove when the main housing is rotated.

In these respects, the engine block cylinder groove cleaner according to the present invention substantially departs from the conventional concepts and designs of the prior art, and in so doing provides an apparatus primarily developed for the purpose of cleaning the grooves in the cylinder of a diesel engine.

SUMMARY OF THE INVENTION

In view of the foregoing disadvantages inherent in the known types of extensible cleaning tools now present in the prior art, the present invention provides a new engine block cylinder groove cleaner construction wherein the same can be utilized for cleaning the grooves in the cylinder of a diesel engine.

The general purpose of the present invention, which will be described subsequently in greater detail, is to provide a new engine block cylinder groove cleaner apparatus and method which has many of the advantages of the extensible cleaning tools mentioned heretofore and many novel features that result in a new engine block cylinder groove cleaner which is not anticipated, rendered obvious, suggested, or even implied by any of the prior art extensible cleaning tools, either alone or in any combination thereof.

To attain this, the present invention generally comprises a main housing comprising a lower portion designed for insertion into a cylinder of an engine block. A plurality of groove cleaning members each being outwardly extendable from the lower portion such that a distal portion of each of the groove cleaning members is designed for snug insertion into a circumferential groove extending around the cylinder of the engine block. The groove cleaning member scrapes out debris from the circumferential groove when the main housing is rotated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new engine block cylinder groove cleaner apparatus and method which has many of the advantages of the extensible cleaning tools mentioned heretofore and many novel features that result in a new engine block cylinder groove cleaner which is not anticipated, rendered obvious, suggested, or even implied by any of the prior art extensible cleaning tools, either alone or in any combination thereof.

It is another object of the present invention to provide a new engine block cylinder groove cleaner which may be easily and efficiently manufactured and marketed.

It is a further object of the present invention to provide a new engine block cylinder groove cleaner which is of a durable and reliable construction.

An even further object of the present invention is to provide a new engine block cylinder groove cleaner which is susceptible of a low cost of manufacture with regard to both materials and labor, and which accordingly is then susceptible of low prices of sale to the consuming public, thereby making such engine block cylinder groove cleaner economically available to the buying public.

Still yet another object of the present invention is to provide a new engine block cylinder groove cleaner which provides in the apparatuses and methods of the prior art some of the advantages thereof, while simultaneously overcoming some of the disadvantages normally associated therewith.

Still another object of the present invention is to provide a new engine block cylinder groove cleaner for cleaning the grooves in the cylinder of a diesel engine.

Yet another object of the present invention is to provide a new engine block cylinder groove cleaner which includes a main housing comprising a lower portion designed for insertion into a cylinder of an engine block. A plurality of groove cleaning members each being outwardly extendable from the lower portion such that a distal portion of each of the groove cleaning members is designed for snug insertion into a circumferential groove extending around the cylinder of the engine block. The groove cleaning member scrapes out debris from the circumferential groove when the main housing is rotated.

Still yet another object of the present invention is to provide a new engine block cylinder groove cleaner that provides a way of incrementally cleaning the grooves in the cylinder of a diesel engine.

Even still another object of the present invention is to provide a new engine block cylinder groove cleaner that keeps the groove cleaning members properly aligned with the grooves of the cylinder so as to not damage the grooves during cleaning.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a plan view of the second portion of the disk shaped assembly of the present invention.

FIG. 7 is a cross-sectional view of the second portion of the disk shaped assembly of the present invention taken along line 7—7 of FIG. 6.

DESCRIPTION OF THE PREFERRED EMBODIMENT

Figure 1:
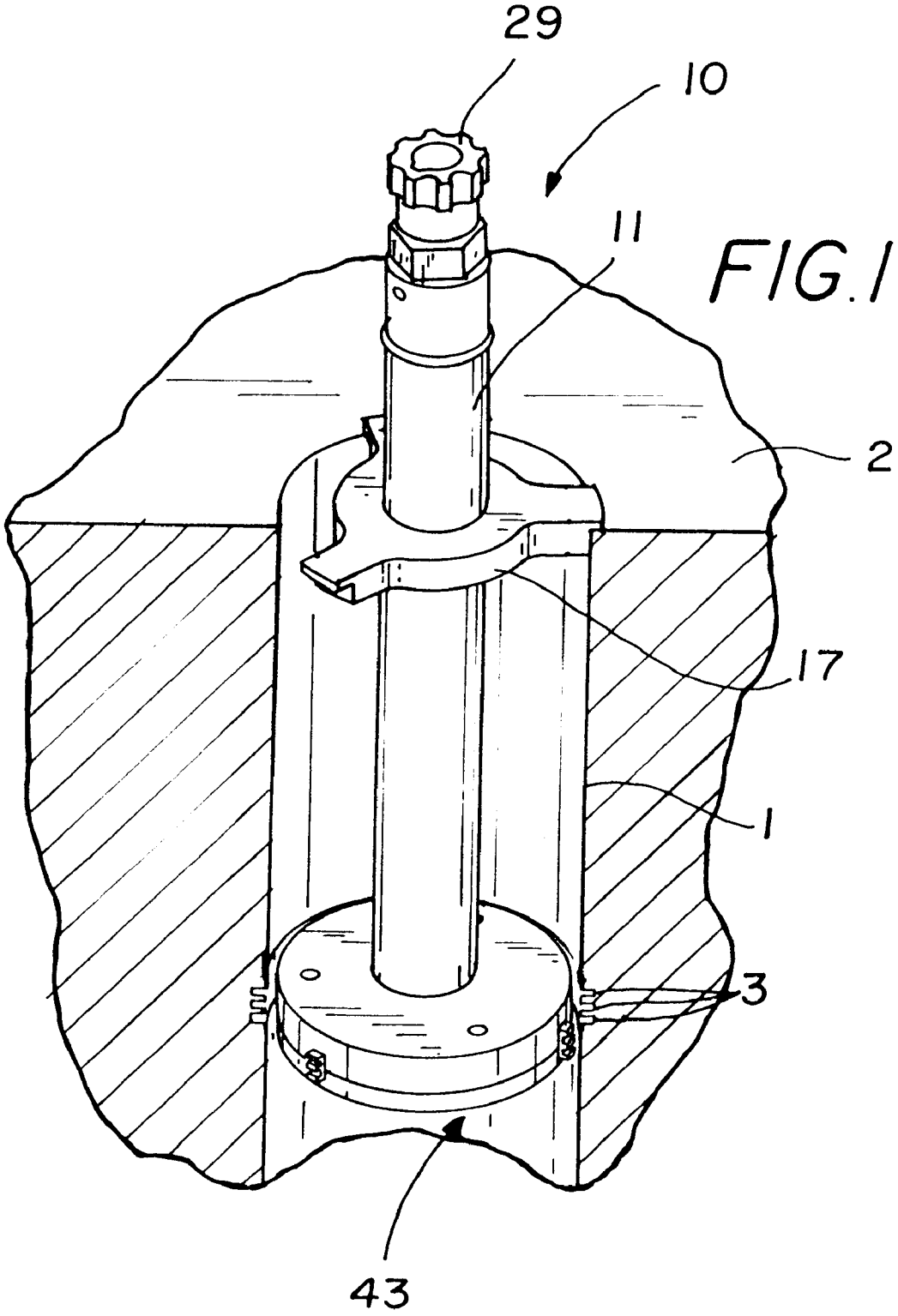
FIG. 1 is a perspective view of a new engine block cylinder groove cleaner according to the present invention in use.
Figure 2:
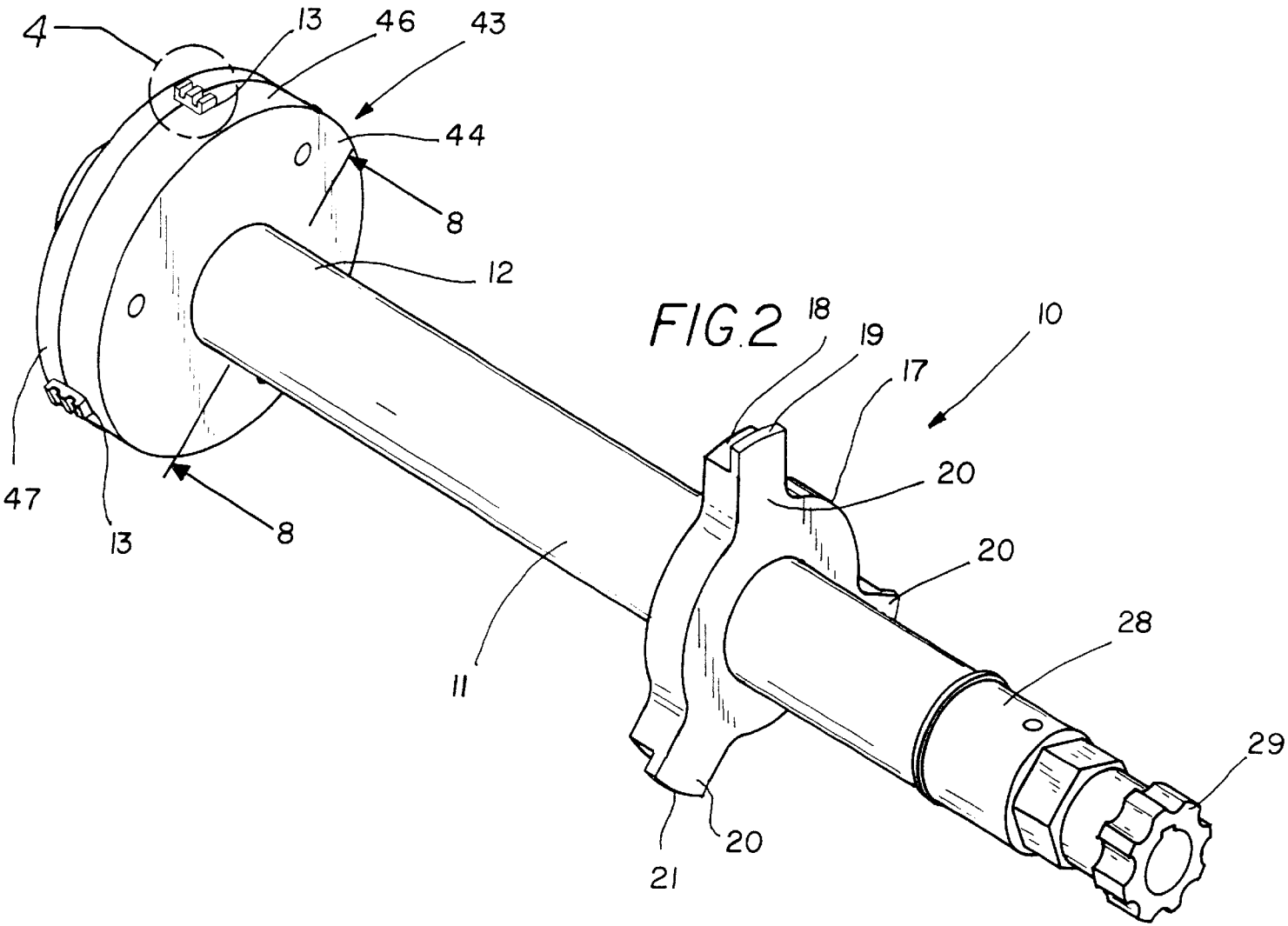
FIG. 2 is a perspective view of the present invention.
Figure 3:
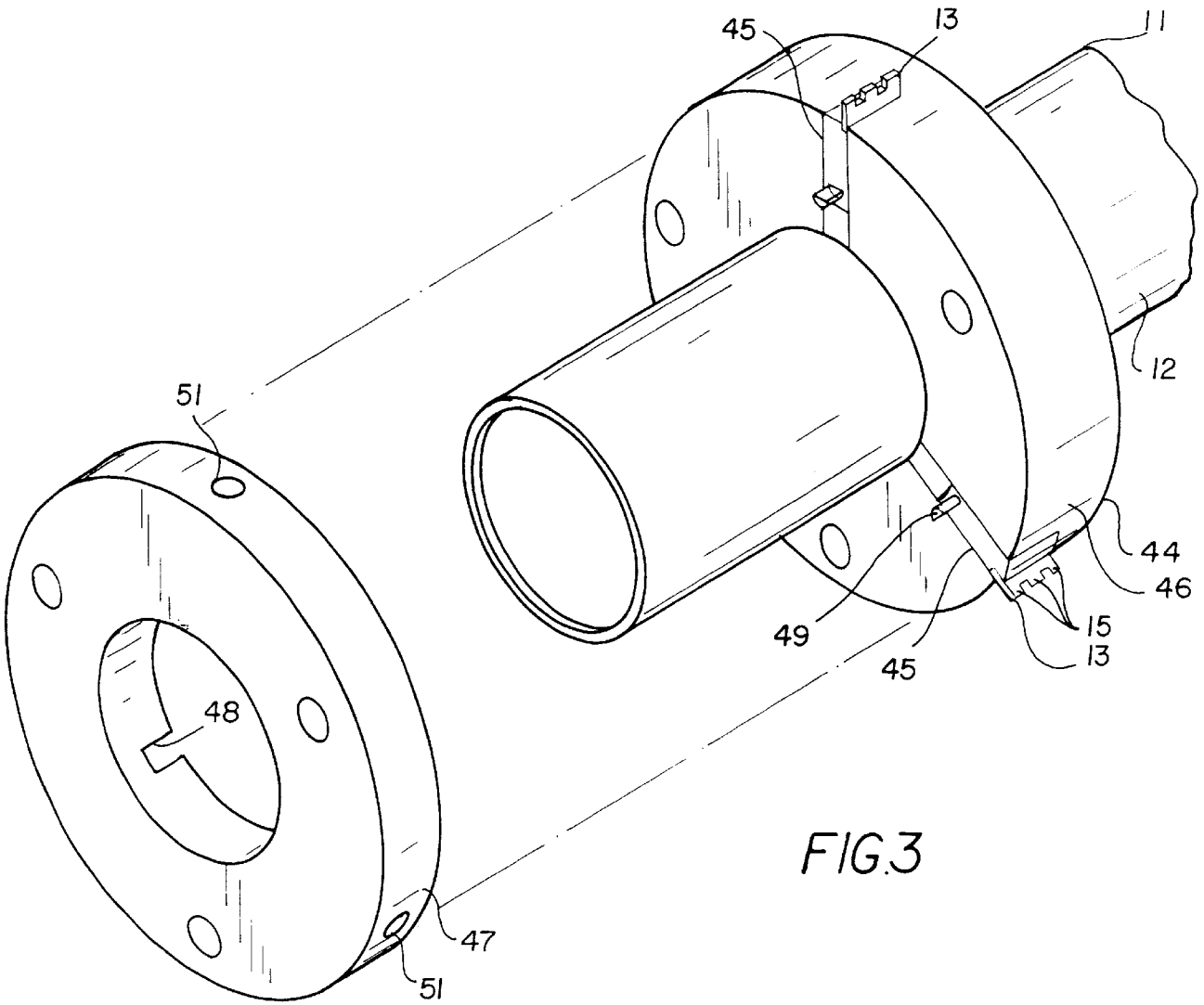
FIG. 3 is an exploded perspective view of the lower portion of the present invention.
Figure 4:
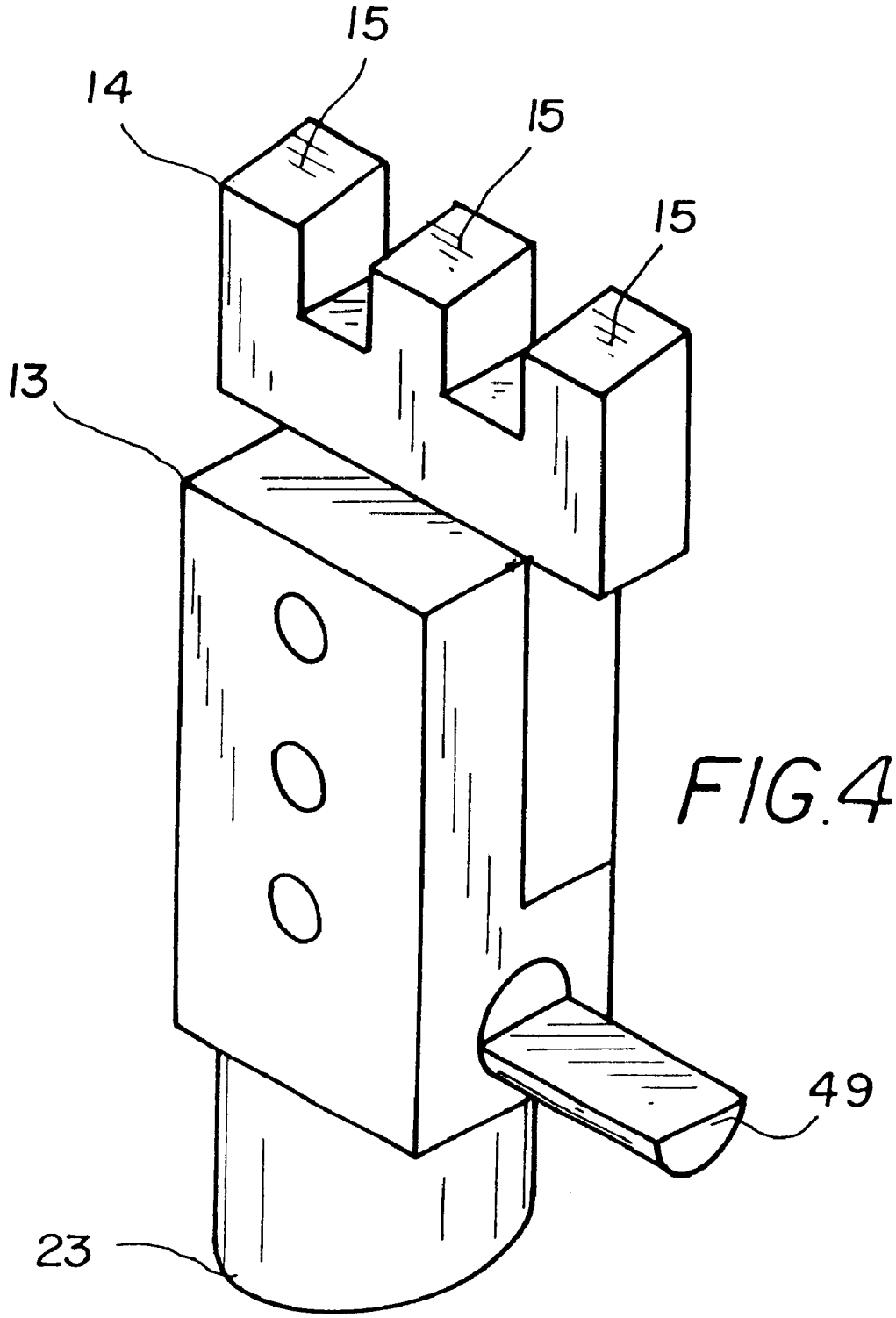
FIG. 4 is an enlarged perspective view of the groove cleaning member of the present invention of the area designated as 4 in FIG. 2.
Figure 5:
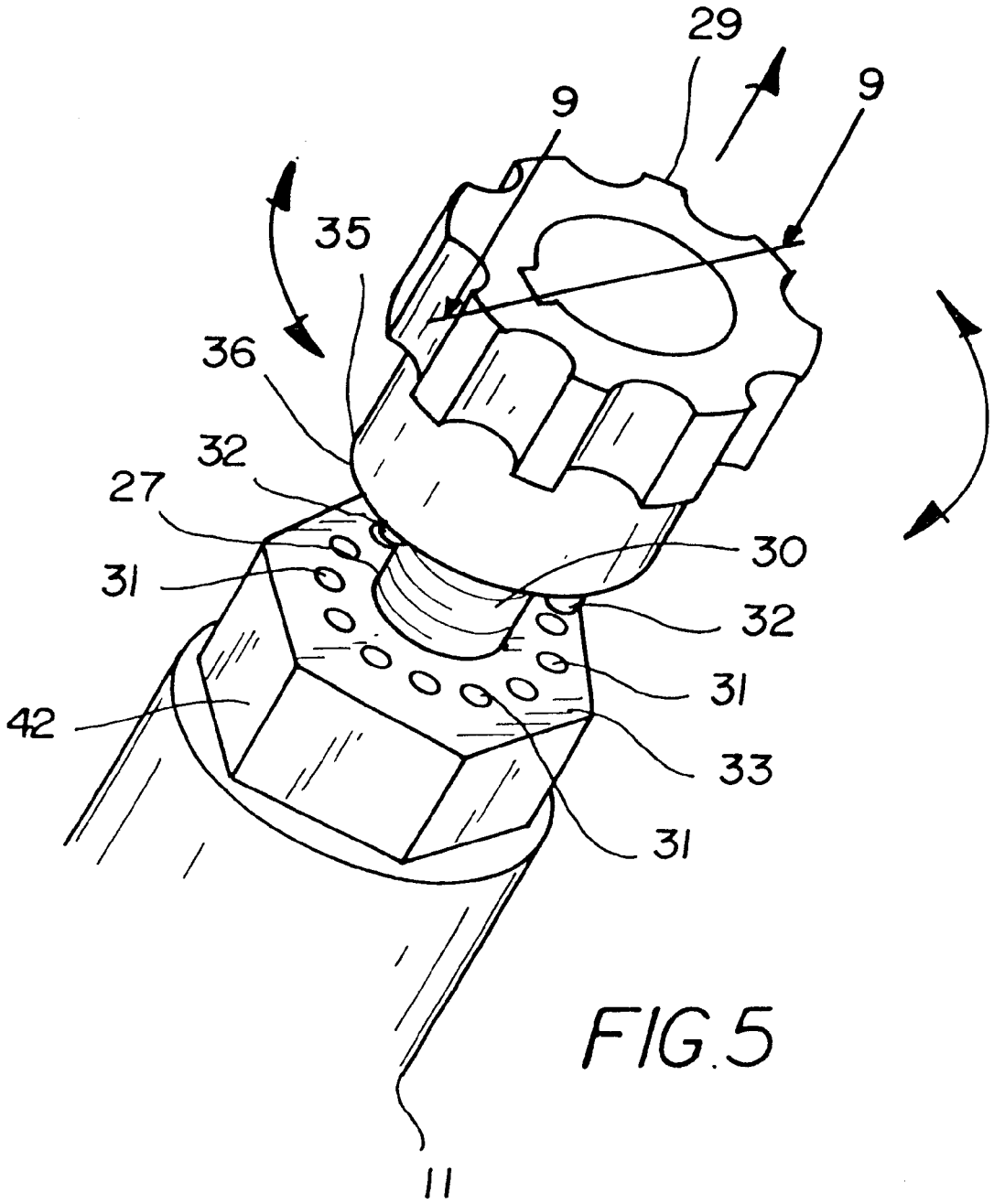
FIG. 5 is an enlarged perspective view of the handle member of the present invention.
Figure 8:
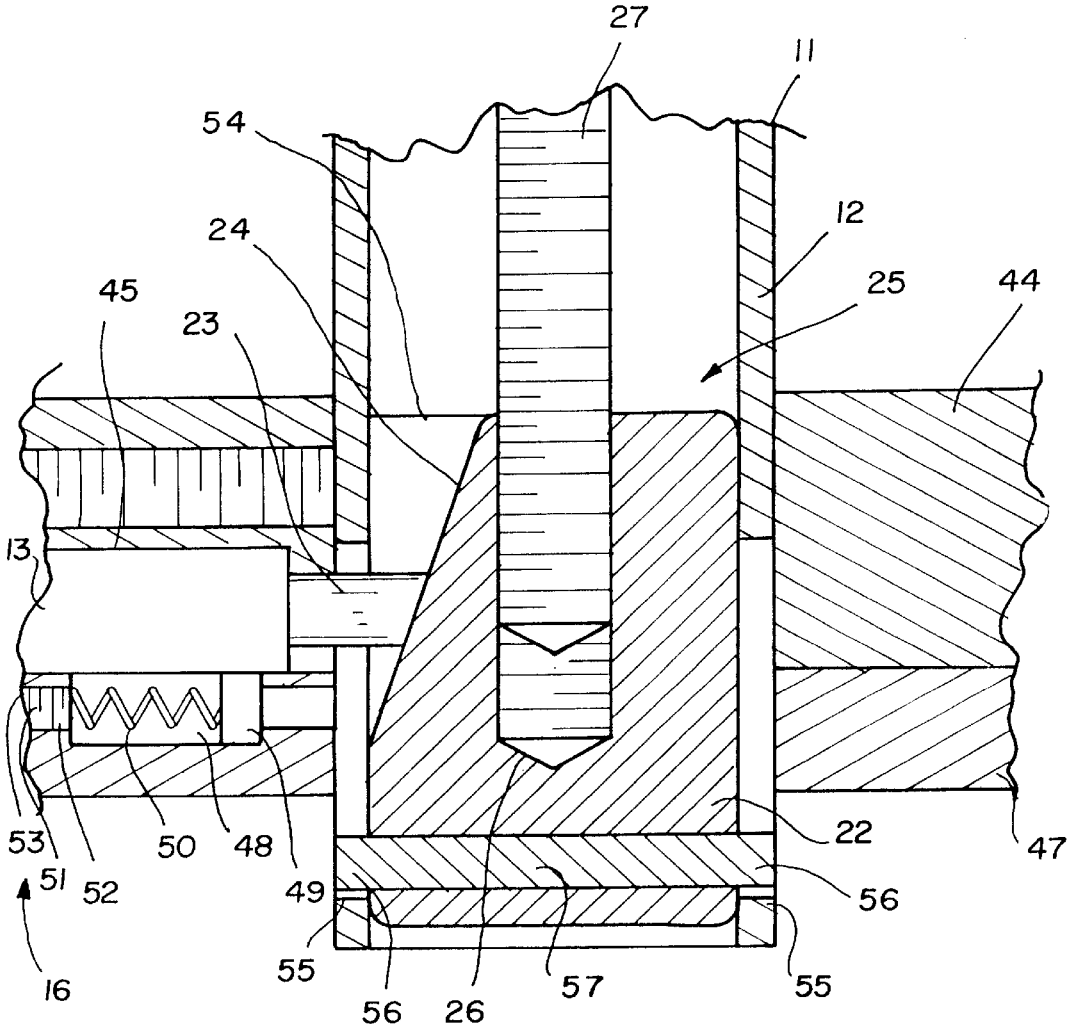
FIG. 8 is a cross-sectional view of the lower portion of the main housing of the present invention as taken along line 8—8 of FIG. 2.
Figure 9:
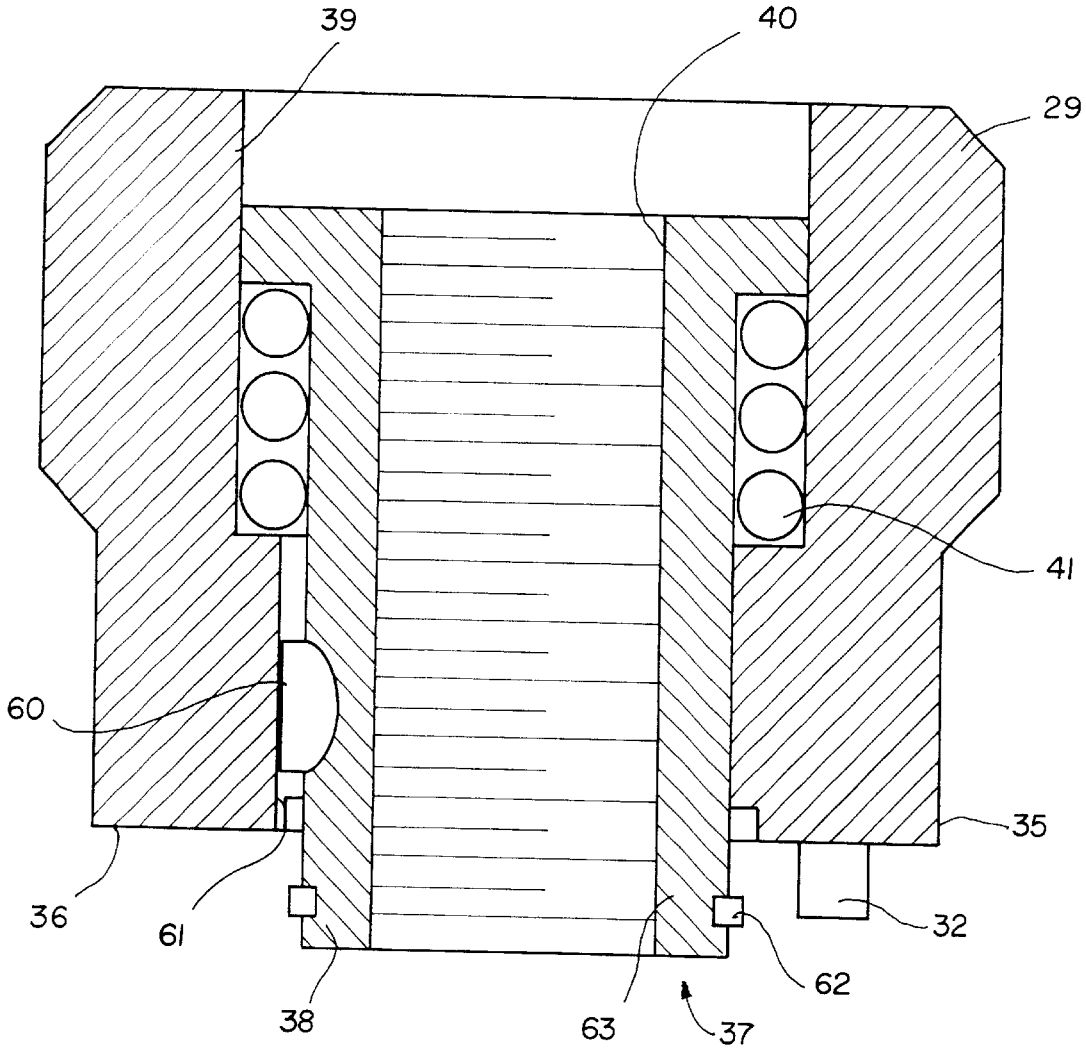
FIG. 9 is a cross-sectional view of the handle member of the main housing of the present invention as taken along line 9—9 of FIG. 5.

With reference now to the drawings, and in particular to FIGS. 1 through 9 thereof, a new engine block cylinder groove cleaner embodying the principles and concepts of the present invention and generally designated by the reference numeral 10 will be described.

As best illustrated in FIGS. 1 through 9, the engine block cylinder groove cleaner 10 generally comprises a main housing 11 having a lower portion 12 designed for insertion into a cylinder 1 of an engine block 2. The main housing has an inner diameter of about 1.5 inches. A plurality of groove cleaning members 13 each being outwardly extendable from the lower portion such that a distal portion 14 of each of the groove cleaning members is designed for snug insertion into a circumferential groove 3 extending around the cylinder of the engine block. The distal portion of each groove cleaning member is for scraping out debris from the circumferential groove when the main housing is rotated. The distal portion of each of the groove cleaning members comprises a plurality of prongs 15 such that each the groove cleaning members is designed for engaging a plurality of spaced circumferential grooves in the cylinder of the engine block. A plurality of groove cleaning member biasing assemblies 16 each being operationally coupled to an associated one of the groove cleaning members for biasing the associated groove cleaning member inwardly relative to the lower portion of the main housing.

An alignment plate 17 is couplable to the main housing in spaced relationship to the lower portion of the main housing. The alignment plate extends outwardly from the main housing for holding the main housing in coaxial relationship to the cylinder of the engine block when the alignment plate is inserted into the cylinder. A first face 18 of the alignment plate comprises a first diameter less than a diameter of the cylinder of the engine block. A second face 19 of the alignment plate comprises a second diameter greater than the diameter of the cylinder of the engine block to form a ridge designed for engaging a top of the cylinder of the engine block when the lower portion of the main housing is inserted into the cylinder. The alignment plate has a thickness of about 0.5 of an inch with a plurality of arms 20 such that each arm has the first face and the second face at a distal end 21 thereof. The arms are about 1 inch in width with the arms being positioned at a 120° from longitudinal axis of one of the arms to the longitudinal axis of an adjacent arm. The diameter of the second face of the alignment plate can be inserted into the cylinder of an engine having a greater diameter cylinder. For example, the diameter of the first face of the alignment plate is designed to fit into the cylinder of a 4020 gasoline engine whereas the diameter of the second face of the alignment plate is designed to fit into the cylinder of a 4020 diesel engine.

An expansion member 22 is positioned in the lower portion of the main housing. Each of the groove cleaning members comprises an angled proximal end 23 for abutting an associated angled surface 24 of the expansion member. An expansion member moving assembly 25 is coupled to the expansion member for moving the expansion member such that each of the groove cleaning members is urged outwardly from the lower portion of the main housing.

The expansion member moving assembly further includes the expansion member comprising an aperture 26 extending through a center of the expansion member. A threaded rod 27 is insertable through the aperture of the expansion member. The threaded rod extends outwardly from an upper end 28 of the main housing. The threaded rod has a diameter of about 0.5 inch. A handle member 29 is couplable to an upper end 30 of the threaded rod. The handle is rotatable such that the rod and the expansion member are movable through the main housing such that the groove cleaning members are urged outwardly from the lower portion of the main housing.

The main housing includes a handle securing aperture 31. The handle member includes a protrusion 32 extending from the handle member. The protrusion is for inserting into the handle securing aperture for holding the handle member in a static position relative to the main housing such that the threaded rod is prevented from rotating. An upper surface 33 of the main housing includes a plurality of radially spaced handle securing apertures such that the plurality of holes are 30° apart. The protrusion extends from an outer perimeter 35 of a lower surface 36 of the handle member. The protrusion is for inserting into a selectable one of the handle securing apertures for holding the handle member in a static position relative to the main housing whereby the threaded rod is prevented from rotating.

The outer perimeter portion of the handle member is slidable relative to an axis of the handle member for selectively disengaging the protrusion from the selected handle securing aperture for permitting rotation of the threaded rod such that the groove cleaning members are extendable a discrete distance by rotating the handle member and inserting the protrusion into an adjacent handle securing aperture relative to the selected handle securing aperture. The handle member includes a handle biasing assembly 37 for biasing the protrusion into the selectable one of the handle securing apertures. The handle biasing assembly includes an inner sleeve 38 for insertion into a bore 39 through the handle member such that the inner sleeve is slidable in relation to the handle member. The inner sleeve has a key 60 for engaging a keyway 61 in the handle for preventing rotation of the inner sleeve in relation to the handle member. The inner sleeve has a threaded bore 40 therethrough for engaging the threaded rod. The handle biasing assembly further includes a spring 41 between the inner sleeve and the handle member for biasing the handle towards the main housing. An outer perimeter 42 of an upper portion of the main housing is nut shaped whereby the main housing is designed for being rotated by a wrench. The inner sleeve has a snap ring 62 around a lower portion 63 of the inner sleeve for engaging the lower surface of the handle member such that the spring is prevented from biasing the inner sleeve away from the handle member.

The lower portion of the main housing includes a generally disk-shaped assembly 43. The disk-shaped assembly comprises a first portion 44. The first portion comprises a plurality of cleaning member apertures 45 radially positioned around an outer perimeter wall 46 of the first portion. Each of the cleaning member apertures is for holding a respective one of the plurality of groove cleaning members. The disk-shaped assembly comprises a second portion 47 for positioning adjacently to the first portion to form the disk-shaped assembly. The second portion comprises plurality of biasing assembly chambers 48. Each biasing assembly chamber is positionable proximate an associated one of the cleaning member apertures when the second portion is positioned adjacent the first portion.

Each of the groove cleaning members comprises a stop member 49 extending into the associated biasing assembly chamber when the groove cleaning member is positioned in the associated cleaning member aperture and the associated biasing assembly chamber is positioned adjacent to the associated cleaning member aperture. A plurality of biasing members 50 each being positionable in an associated one of the biasing assembly chambers such that the biasing member abuts the stop member such that the groove cleaning member is biased inwardly from an outer perimeter of the disk-shaped assembly. Each biasing assembly chamber includes an associated threaded portion 51 extending between a main portion 52 of the biasing assembly chamber and the outer perimeter of the disk-shaped assembly. Each associated threaded portion is configured to permit insertion of the associated biasing member into the main portion of the biasing assembly chamber. A plurality of set screws 53 each being selectively engageable to an associated one of the threaded portions of the biasing assembly chamber whereby the associated biasing member is held within the main portion of the associated biasing assembly chamber.

The expansion member is generally disk-shaped with a diameter of about 1.5 inches and includes a plurality of wedge-shaped cutouts 54. Each cutout is aligned with an associated one of the groove cleaning members for forming the associated angled surface such that the angle of the angle of the associated angled surface is 18°. The main housing includes a pair of alignment slots 55. The expansion member includes a pair of oppositional protrusions 56 for inserting into the alignment slots for holding each the wedge shaped cutouts in alignment with the associated groove cleaning member. The oppositional protrusions are formed by a retaining pin 57 inserted through the expansion member.

In use, the user removes the sleeve and the O-ring gaskets from the cylinder of a diesel engine. The main housing is then inserted into the cylinder until the alignment member engages the top of the cylinder. The groove cleaning members of the lower portion should then be in alignment with the grooves in the cylinder where the O-rings were seated. The handle member is then drawn back away from the main housing and rotated a desired increment such that the protrusion of the handle member is inserted into one of the handle securing apertures. The rotation of the handle member causes a threaded rod to be rotated which draws the expansion member up the main housing thereby extending the distal ends of the groove cleaning members away from the lower portion of the main housing. The user can then rotate the main housing via the nut shaped upper portion such that the groove cleaning members are rotated and clean debris from the grooves of the cylinder. The above process of the moving the handle member and rotating the main housing is repeated until the grooves are cleared of debris. When the grooves are cleared the handle member can then be rotated in the opposite direction thereby retracting the distal ends of the groove cleaning members into the lower portion of the main housing. The main housing is then removed and a new set of O-rings are placed in the grooves of the cylinder and a sleeve is replaced within the cylinder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An engine block cylinder groove cleaning device comprising:

a main housing having a lower portion adapted for insertion into a cylinder of an engine block;

a plurality of groove cleaning members, each of said groove cleaning members being outwardly extendable from said lower portion such that a distal portion of each of said groove cleaning members is adapted for snug insertion into a circumferential groove extending around the cylinder of the engine block whereby said groove cleaning member scrapes out debris from the circumferential groove when the main housing is rotated;

an expansion member positioned in said lower portion of said main housing;

each of said groove cleaning members having an angled proximal end for abutting an associated angled surface of said expansion member; and an expansion member moving assembly coupled to said expansion member for moving said expansion member whereby each of said groove cleaning members is urged outwardly from said lower portion of said main housing.

2. The engine block cylinder groove cleaning device of claim 1, further comprising:

said distal portion of each of said groove cleaning members having a plurality of prongs whereby each said groove cleaning member is adapted for engaging a plurality of spaced circumferential grooves in the cylinder of the engine block.

3. The engine block cylinder groove cleaning device of claim 1, further comprising:

an alignment plate couplable to said main housing in spaced relationship to said lower portion of said main housing, said alignment plate extending outwardly from said main housing for holding said main housing in coaxial relationship to the cylinder of the engine block when said alignment plate is inserted into the cylinder.

4. The engine block cylinder groove cleaning device of claim 3, further comprising:

a first face of said alignment plate having a first diameter less than a diameter of the cylinder of the engine block; and a second face of said alignment plate having a second diameter greater than the diameter of the cylinder of the engine block to form a ridge adapted for engaging a top of the cylinder of the engine block when said lower portion of said main housing is inserted into the cylinder.

5. The engine block cylinder groove cleaning device of claim 1, wherein said expansion member moving assembly further comprises:

said expansion member having an aperture extending through a center of said expansion member;

a threaded rod insertable through said aperture of said expansion member, said threaded rod extending outwardly from an upper end of said main housing;

a handle member threadably coupled to an upper end of said threaded rod, said handle being rotatable such that said rod and said expansion member are movable through said main housing whereby said groove cleaning members are urged outwardly from said lower portion of said main housing.

6. The engine block cylinder groove cleaning device of claim 5, further comprising:

said main housing including a handle securing aperture;

said handle member including a protrusion extending from said handle member, said protrusion being for inserting into said handle securing aperture for holding said handle member in a static position relative to said main housing whereby said threaded rod is prevented from rotating.

7. The engine block cylinder groove cleaning device of claim 5, further comprising:

an upper surface of said main housing including a plurality of radially spaced handle securing apertures;

said handle member including a protrusion extending from an outer perimeter of a lower surface of said handle member, said protrusion being for inserting into a selectable one of said handle securing apertures for holding said handle member in a static position relative to said main housing whereby said threaded rod is prevented from rotating;

said outer perimeter portion of said handle member being slidable relative to an axis of said handle member for selectively disengaging said protrusion from said selected handle securing aperture for permitting rotation of said threaded rod whereby said groove cleaning members are extendable a discrete distance by rotating said handle member and inserting said protrusion into an adjacent handle securing aperture relative to said selected handle securing aperture; and said handle member including a handle biasing assembly for biasing said protrusion into said selectable one of said handle securing apertures.

8. The engine block cylinder groove cleaning device of claim 1, further comprising:

an outer perimeter of an upper portion of said main housing being nut shaped whereby said main housing is adapted for being rotated by a wrench.

9. The engine block cylinder groove cleaning device of claim 1, further comprising:

a plurality of groove cleaning member biasing assemblies, each groove cleaning member biasing assembly being operationally coupled to an associated one of said groove cleaning members for biasing said associated groove cleaning member inwardly relative to said lower portion of said main housing.

10. The engine block cylinder groove cleaning device of claim 1, further comprising:

said expansion member being generally disk-shaped and including a plurality of wedge-shaped cutouts, each cutout being aligned with an associated one of said groove cleaning members for forming said associated angled surface.

11. The engine block cylinder groove cleaning device of claim 10, further comprising:

said main housing including a pair of alignment slots;

said expansion member including a pair of oppositional protrusions for inserting into said alignment slots for holding each said wedge shaped cutout in alignment with said associated groove cleaning member.

12. The engine block cylinder groove cleaning device of claim 11, further comprising:

said oppositional protrusions being formed by a retaining pin inserted through said expansion member.

13. An engine block cylinder groove cleaning device comprising:

a main housing having a lower portion adapted for insertion into a cylinder of an engine block;

a plurality of groove cleaning members, each of said groove cleaning members being outwardly extendable from said lower portion such that a distal portion of each of said groove cleaning members is adapted for snug insertion into a circumferential groove extending around the cylinder of the engine block whereby said groove cleaning member scrapes out debris from the circumferential groove when the main housing is rotated;

a plurality of groove cleaning member biasing assemblies, each groove cleaning member biasing assembly being operationally coupled to an associated one of said groove cleaning members for biasing said associated groove cleaning member inwardly relative to said lower portion of said main housing;

said lower portion of said main housing including a generally disk-shaped assembly, said disk-shaped assembly having a first portion, said first portion having a plurality of cleaning member apertures radially positioned around an outer perimeter wall of said first portion, each of said cleaning member apertures being for holding a respective one of said plurality of groove cleaning members;

said disk-shaped assembly having a second portion for positioning adjacently to said first portion to form said disk-shaped assembly, said second portion having plurality of biasing assembly chambers, each biasing assembly chamber being positionable proximate an associated one of said cleaning member apertures when said second portion is positioned adjacent said first portion;

each of said groove cleaning members having a stop member extending into said associated biasing assembly chamber when said groove cleaning member is positioned in said associated cleaning member aperture and said associated biasing assembly chamber is positioned adjacent to said associated cleaning member aperture;

a plurality of biasing members, each biasing member being positionable in an associated one of said biasing assembly chambers such that said biasing member abuts said stop member whereby said groove cleaning member is biased inwardly from an outer perimeter of said disk-shaped assembly.

14. The engine block cylinder groove cleaning device of claim 13, further comprising:

each biasing assembly chamber including an associated threaded portion extending between a main portion of said biasing assembly chamber and said outer perimeter of said disk-shaped assembly, each associated threaded portion being configured to permit insertion of said associated biasing member into said main portion of said biasing assembly chamber; and a plurality of set screws, each set screw being selectively engageable to an associated one of said threaded portions of said biasing assembly chamber whereby said associated biasing member is held within said main portion of said associated biasing assembly chamber.

15. An engine block cylinder groove cleaning device comprising:

a main housing having a lower portion adapted for insertion into a cylinder of an engine block;

a plurality of groove cleaning members, each of said groove cleaning members being outwardly extendable from said lower portion such that a distal portion of each of said groove cleaning members is adapted for snug insertion into a circumferential groove extending around the cylinder of the engine block whereby said groove cleaning member scrapes out debris from the circumferential groove when the main housing is rotated;

said distal portion of each of said groove cleaning members having a plurality of prongs whereby each said groove cleaning member is adapted for engaging a plurality of spaced circumferential grooves in the cylinder of the engine block;

an alignment plate couplable to said main housing in spaced relationship to said lower portion of said main housing, said alignment plate extending outwardly from said main housing for holding said main housing in coaxial relationship to the cylinder of the engine block when said alignment plate is inserted into the cylinder;

a first face of said alignment plate having a first diameter less than a diameter of the cylinder of the engine block;

a second face of said alignment plate having a second diameter greater than the diameter of the cylinder of the engine block to form a ridge adapted for engaging a top of the cylinder of the engine block when said lower portion of said main housing is inserted into the cylinder;

an expansion member positioned in said lower portion of said main housing;

each of said groove cleaning members having an angled proximal end for abutting an associated angled surface of said expansion member;

an expansion member moving assembly coupled to said expansion member for moving said expansion member whereby each of said groove cleaning members is urged outwardly from said lower portion of said main housing;

wherein said expansion member moving assembly further includes said expansion member having an aperture extending through a center of said expansion member;

a threaded rod insertable through said aperture of said expansion member, said threaded rod extending outwardly from an upper end of said main housing;

a handle member threadably coupled to an upper end of said threaded rod, said handle being rotatable such that said rod and said expansion member are movable through said main housing whereby said groove cleaning members are urged outwardly from said lower portion of said main housing;

said main housing including a handle securing aperture;

said handle member including a protrusion extending from said handle member, said protrusion being for inserting into said handle securing aperture for holding said handle member in a static position relative to said main housing whereby said threaded rod is prevented from rotating;

an upper surface of said main housing including a plurality of radially spaced handle securing apertures;

said protrusion extending from an outer perimeter of a lower surface of said handle member, said protrusion being for inserting into a selectable one of said handle securing apertures for holding said handle member in a static position relative to said main housing whereby said threaded rod is prevented from rotating;

said outer perimeter portion of said handle member being slidable relative to an axis of said handle member for selectively disengaging said protrusion from said selected handle securing aperture for permitting rotation of said threaded rod whereby said groove cleaning members are extendable a discrete distance by rotating said handle member and inserting said protrusion into an adjacent handle securing aperture relative to said selected handle securing aperture;

said handle member including a handle biasing assembly for biasing said protrusion into said selectable one of said handle securing apertures;

an outer perimeter of an upper portion of said main housing being nut shaped whereby said main housing is adapted for being rotated by a wrench;

a plurality of groove cleaning member biasing assemblies, each groove cleaning member biasing assembly being operationally coupled to an associated one of said groove cleaning members for biasing said associated groove cleaning member inwardly relative to said lower portion of said main housing;

said lower portion of said main housing including a generally disk-shaped assembly, said disk-shaped assembly having a first portion, said first portion having a plurality of cleaning member apertures radially positioned around an outer perimeter wall of said first portion, each of said cleaning member apertures being for holding a respective one of said plurality of groove cleaning members;

said disk-shaped assembly having a second portion for positioning adjacently to said first portion to form said disk-shaped assembly, said second portion having plurality of biasing assembly chambers, each biasing assembly chamber being positionable proximate an associated one of said cleaning member apertures when said second portion is positioned adjacent said first portion;

each of said groove cleaning members having a stop member extending into said associated biasing assembly chamber when said groove cleaning member is positioned in said associated cleaning member aperture and said associated biasing assembly chamber is positioned adjacent to said associated cleaning member aperture;

a plurality of biasing members, each biasing member being positionable in an associated one of said biasing assembly chambers such that said biasing member abuts said stop member whereby said groove cleaning member is biased inwardly from an outer perimeter of said disk-shaped assembly;

each biasing assembly chamber including an associated threaded portion extending between a main portion of said biasing assembly chamber and said outer perimeter of said disk-shaped assembly, each associated threaded portion being configured to permit insertion of said associated biasing member into said main portion of said biasing assembly chamber;

a plurality of set screws, each set screw being selectively engageable to an associated one of said threaded portions of said biasing assembly chamber whereby said associated biasing member is held within said main portion of said associated biasing assembly chamber;

said expansion member being generally disk-shaped and including a plurality of wedge-shaped cutouts, each cutout being aligned with an associated one of said groove cleaning members for forming said associated angled surface;

said main housing including a pair of alignment slots;

said expansion member including a pair of oppositional protrusions for inserting into said alignment slots for holding each said wedge shaped cutout in alignment with said associated groove cleaning member; and said oppositional protrusions being formed by a retaining pin inserted through said expansion member.

16. An engine block cylinder groove cleaning device comprising:

a main housing having a lower portion adapted for insertion into a cylinder of an engine block;

a plurality of groove cleaning members, each of said groove cleaning members being outwardly extendable from said lower portion such that a distal portion of each of said groove cleaning members is adapted for snug insertion into a circumferential groove extending around the cylinder of the engine block whereby said groove cleaning member scrapes out debris from the circumferential groove when the main housing is rotated;

an expansion member positioned in said lower portion of said main housing; and an expansion member moving assembly coupled to said expansion member for moving said expansion member whereby each of said groove cleaning members is urged outwardly from said lower portion of said main housing.

17. The engine block cylinder groove cleaning device of claim 16, wherein said expansion member moving assembly further comprises:

a handle member operationally coupled to said expansion member, said handle being rotatable such that said expansion member is movable whereby said groove cleaning members are urged outwardly from said lower portion of said main housing.

18. The engine block cylinder groove cleaning device of claim 17, further comprising:

said main housing including a handle securing aperture;

said handle member including a protrusion extending from said handle member, said protrusion being for inserting into said handle securing aperture for holding said handle member in a static position relative to said main housing whereby said handle member is prevented from rotating.

19. The engine block cylinder groove cleaning device of claim 17, further comprising:

an upper surface of said main housing including a plurality of radially spaced handle securing apertures;

said handle member including a protrusion extending from an outer perimeter of a lower surface of said handle member, said protrusion being for inserting into a selectable one of said handle securing apertures for holding said handle member in a static position relative to said main housing whereby said handle member is prevented from rotating;

said outer perimeter portion of said handle member being slidable relative to an axis of said handle member for selectively disengaging said protrusion from said selected handle securing aperture for permitting rotation of said handle member whereby said groove cleaning members are extendable a discrete distance by rotating said handle member and inserting said protrusion into an adjacent handle securing aperture relative to said selected handle securing aperture.

20. The engine block cylinder groove cleaning device of claim 19, further comprising:

said handle member including a handle biasing assembly for biasing said protrusion into said selectable one of said handle securing apertures.

* * * * *